US006055896A

United States Patent [19]

Molison

[11] Patent Number: 6,055,896

[45] Date of Patent: May 2, 2000

[54] STACKING MACHINE AND METHOD

[75] Inventor: Robert E. Molison, Hanover, Pa.

[73] Assignee: Elsner Engineering Works, Inc., Hanover, Pa.

[21] Appl. No.: 09/196,925

[22] Filed: Nov. 19, 1998

Related U.S. Application Data

[62] Division of application No. 08/895,848, Jul. 17, 1997, Pat. No. 5,970,833.

[51] Int. Cl.[7] ..... B26D 7/06; B26D 1/00

[52] U.S. Cl. ..... 83/29; 83/84; 83/86; 83/87; 83/94; 83/155; 83/155.1; 83/151

[58] Field of Search ..... 83/84, 86, 87, 83/94, 155, 155.1, 151, 142, 143, 13, 27, 29

[56] References Cited

U.S. PATENT DOCUMENTS

| | | | |
|---|---|---|---|
| 1,205,282 | 11/1916 | Spiess . | |
| 1,269,308 | 6/1918 | Reifsnyder et al. . | |
| 1,950,880 | 3/1934 | Duncan | 271/64 |
| 2,001,296 | 5/1935 | Barber | 271/76 |
| 3,022,999 | 2/1962 | Mead | 271/68 |
| 3,267,782 | 8/1966 | Benzing | 83/94 |
| 3,284,081 | 11/1966 | Huck | 271/64 |
| 3,672,265 | 6/1972 | Schwarzkopf | 93/93 |
| 3,907,274 | 9/1975 | D'Amato et al. | 271/64 |
| 4,445,681 | 5/1984 | Reist | 271/300 |
| 4,498,664 | 2/1985 | Reist | 271/204 |
| 4,580,473 | 4/1986 | Seiden et al. | 83/23 |
| 4,607,473 | 8/1986 | Ehlus et al. | 53/54 |
| 4,666,143 | 5/1987 | Reist | 271/204 |
| 4,813,661 | 3/1989 | Wegel et al. | 271/204 |
| 4,890,825 | 1/1990 | McCormick et al. | 271/188 |
| 5,356,131 | 10/1994 | Mauro | 271/288 |
| 5,363,728 | 11/1994 | Elsner et al. | 83/23 |
| 5,368,288 | 11/1994 | Philipp et al. | 271/215 |
| 5,370,382 | 12/1994 | Wetter | 271/183 |
| 5,390,911 | 2/1995 | Schmid | 271/300 |
| 5,409,208 | 4/1995 | Schmid | 271/204 |
| 5,431,386 | 7/1995 | Blaser | 271/204 |
| 5,511,935 | 4/1996 | Seefeldt | 414/791.1 |
| 5,640,908 | 6/1997 | Schaede | 101/484 |

*Primary Examiner*—M. Rachuba
*Attorney, Agent, or Firm*—Thomas Hooker, P.C.

[57] ABSTRACT

The disclosure relates to a stacking machine which cuts a multiply rope into bundles, clamps the lead ends of the bundles against a conveyor which moves the bundles to stacking stations where the bundles are collected in stacks. Completed stacks are transferred to a takeaway conveyor.

15 Claims, 5 Drawing Sheets

STACKING MACHINE AND METHOD

This is a division of application Ser. No. 08/895,848 filed Jul. 17, 1997 now U.S. Pat. No. 5,970,833.

FIELD OF THE INVENTION

The invention relates to machines for cutting, conveying and stacking web material and related methods.

DESCRIPTION OF THE PRIOR ART

Conventional stacking machines receive a continuous rope of web material, cut the rope into multiply bundles and stack the bundles. The stacks are discharged for subsequent processing. In a prior machine, disclosed in U.S. Pat. No. 5,328,323, handling of the severed bundles is facilitated because the plies are wetted and cohere to each other. The cohesion holds folded plies on the top of the bundles down flat on the bundles as the severed bundles are moved from the cutting rolls downstream to a stacking station. However, this stacking machine is unsuitable for stacking bundles severed from multiply ropes formed of folded dry web material where the plies are not wetted and the top ply is not cohesively bonded to the lower plies and is susceptible to being blown up and then bent out of proper position on the bundle.

SUMMARY OF THE INVENTIOIN

The invention is an improved article stacking machine and method for continuously stacking articles, typically folded sheets or stacks of folded sheets, supplied to the machine. A cutter cuts a continuous rope to form the articles.

The machine and method are particularly useful in high production rate continuous stacking of bundles severed from the lead end of an indefinite length multiply dry rope fed to the machine. The rope typically includes four or five stacked plies of folded dry web material, such as fabric softener sheets or paper towel sheets. The plies may be folded as desired. A Z-fold is typical. Bundles are stacked without fold back of the sheet edges. While the machine is particularly adapted to rapid production stacking of dry bundles, it may also be used to stack bundles which have been wetted.

Other objects and features of the invention will become apparent as the description proceeds, especially when taken in conjunction with the accompanying drawings illustrating the invention, of which there are five sheets and one embodiment.

DESCRIPTION OF THE PREFERRED EMBODIMENT

Figure 1:
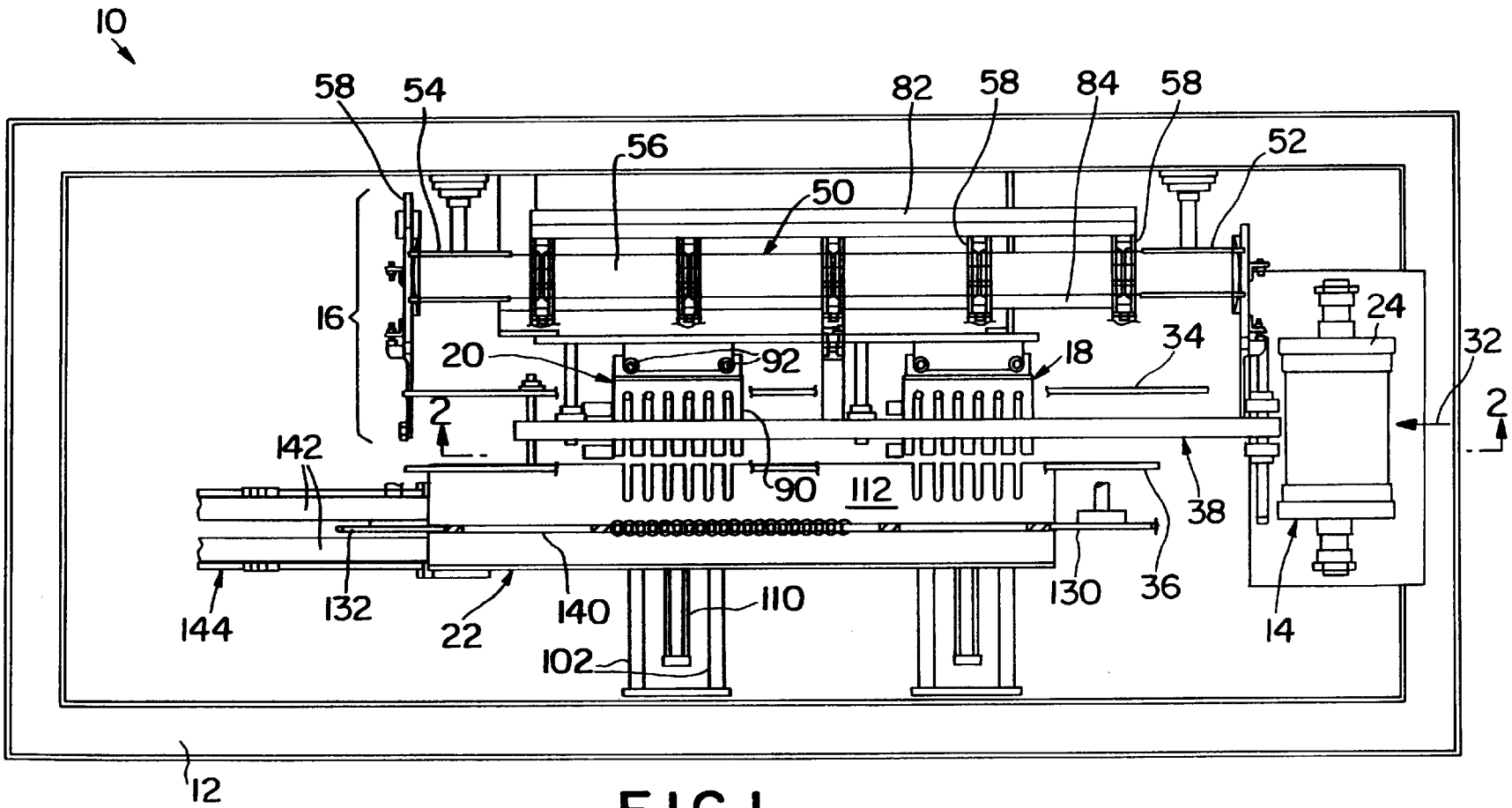
FIG. 1 is a plan view of the invention, partially broken away.

Stacking machine 10 includes a rectangular frame 12 supporting a cutter, a pair of bundle cutoff rolls 14, a bundle conveyor 16 extending downstream from the rolls 14, a pair of like drop-type stations 18 and 20 spaced along conveyor 16 and a stack takeaway conveyor 22 located to one side of bundle conveyor 16.

Figure 2:
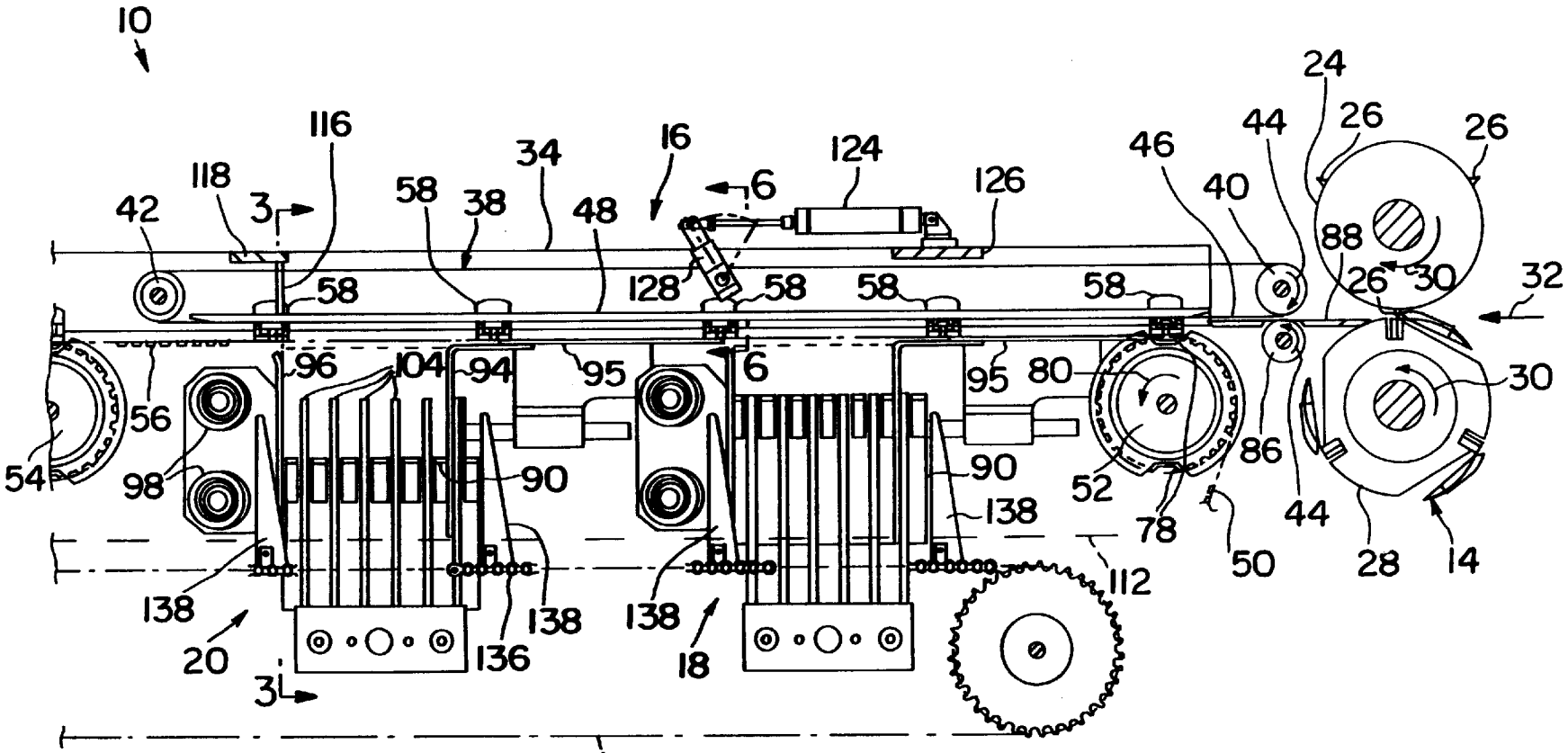
FIG. 2 is a vertical sectional view taken generally along line 2—2 of FIG. 1.

Cutoff rolls 14 are of the type disclosed in U.S. Pat. No. 5,363,728, assigned to Elsner Engineering Works, Inc., the disclosure of which is incorporated herein by reference. The cutter includes a knife roll 24 having three radially extending and circumferentially spaced cutoff knives 26 and an anvil roll 28 located below the knife roll and cooperative with the knife roll. Both rolls 24 and 28 are rotated by appropriate drives in the directions of arrows 30 shown in FIG. 2 to sever the lead end of a flat multiply rope of folded web material. The rope is fed downstream in the direction of arrow 32 between the rolls, as shown in FIGS. 1 and 2. The end of the rope is cut into multiply segments or bundles which are discharged from the cutoff rolls and are fed downstream to the bundle conveyor 16 which moves the bundles to stacking stations 18 and 20.

Conveyor 16 includes a pair of elongate horizontally extending vertical plates 34 and 36 extending in a downstream direction from rolls 14. Continuous flat conveyor belt 38 is wound around a pair of rollers 40 and 42. Roller 40 is located immediately downstream and slightly above the nip between cutoff rolls 14. A suitable drive rotates roll 40 in the direction of arrow 44 to move the lower run 46 of belt 38 in a downstream direction away from the cutoff rolls. Lower run 46 slides along a fixed elongate support plate 48 extending over and past stations 18 and 20.

Endless toothed clamp conveyor belt 50 is wound around a pair of toothed rollers 52 and 54 as shown in FIGS. 1 and 2 and includes an upper run 56 extending between the rollers. Belt 50 and rollers 52 and 54 are offset to one side of belt 38, as illustrated best in FIG. 1. A plurality of clamp arms 58 are mounted on belt 50 and extend from belt 50 toward and under belt 38.

Figures 3, 4, 5:
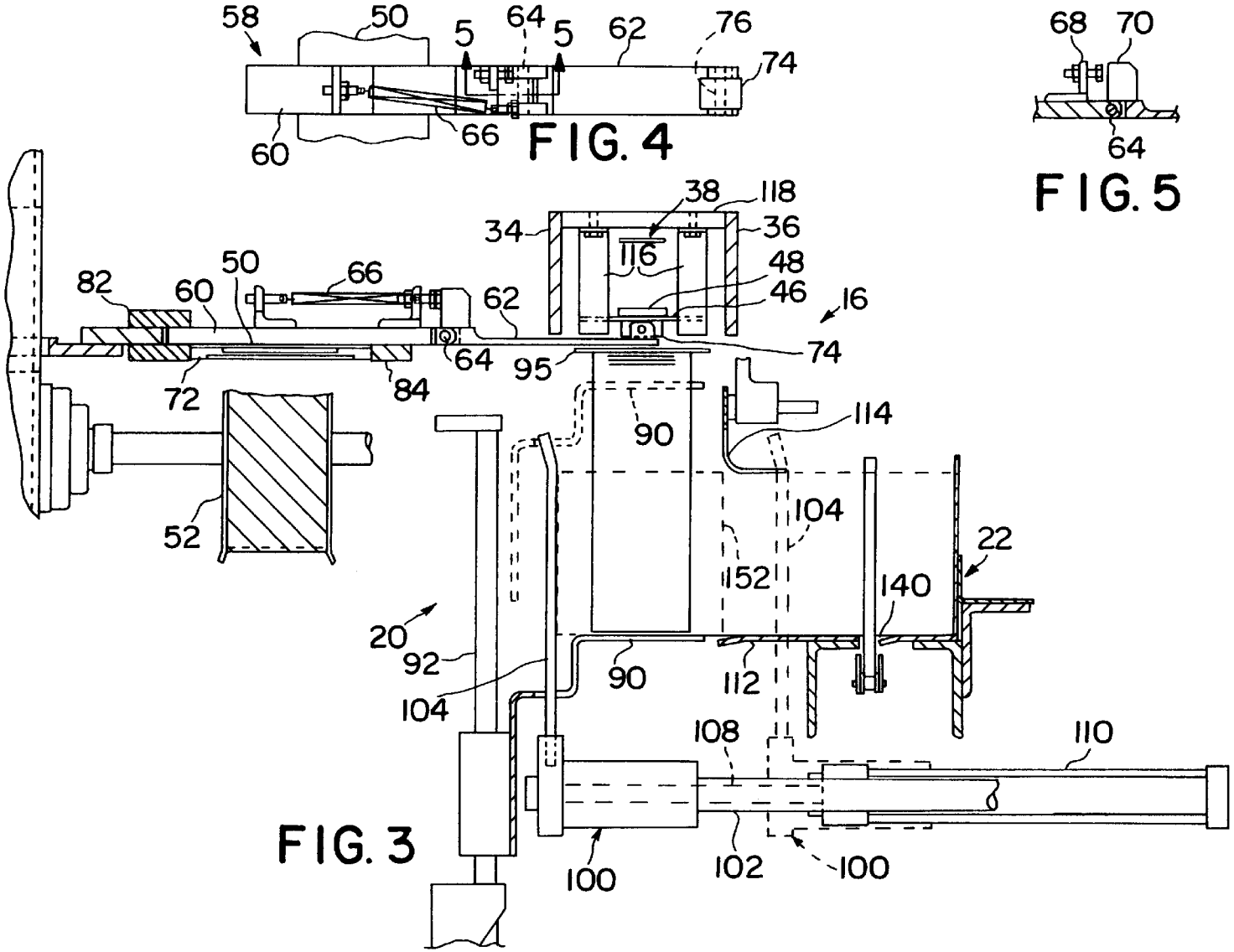
FIG. 3 is a vertical sectional view taken generally along line 3—3 of FIG. 2.
FIG. 4 is a top view of a clamp arm.
FIG. 5 a sectional view taken along line 5—5 of FIG. 4.

Each clamp arm 58 includes an elongate base 60 extended transversely across the outer surface of belt 38 and an arm extension 62 which projects from the base toward and under belt 38, as illustrated in FIG. 3. The extension 62 is connected to base 60 by horizontal hinge connection 64 to permit upward pivoting of the extension toward the lower run 46 of belt 38. Tension spring 66 extends between supports extending above the base 60 and extension 62 to bias the extension upwardly about the hinge connection. Upward pivotal movement of the arm extension is limited by adjustable stop 68 on the base which engages an abutment 70 on extension 62 adjacent the hinge. See FIG. 5.

Mounting plate 72 is secured to the side of base 60 away from spring 66 with belt 50 sandwiched between the plate and the base. The plate includes a rib which fits within a groove on the side of the belt away from the base to accurately hold the clamp arm on the belt in a desired longitudinal position on the belt and with the base extending perpendicularly to the belt.

Clamp element 74, which may be formed of relatively low friction nylon, is mounted on the free end of extension 62 on a pivot pin 76 which permits pivoting of the element about an axis extending parallel to the axis of hinge 64 and along the length of lower belt run 46. Free pivoting of the clamp element about pin 76 insures that the element is held flush against a bundle clamped between the member and belt 38, independent of the thickness of the bundle.

Figure 9:
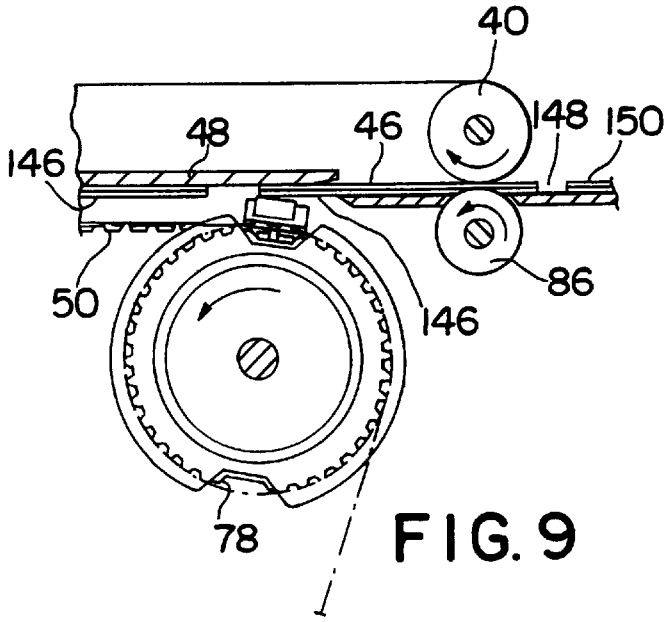
Figure 10:
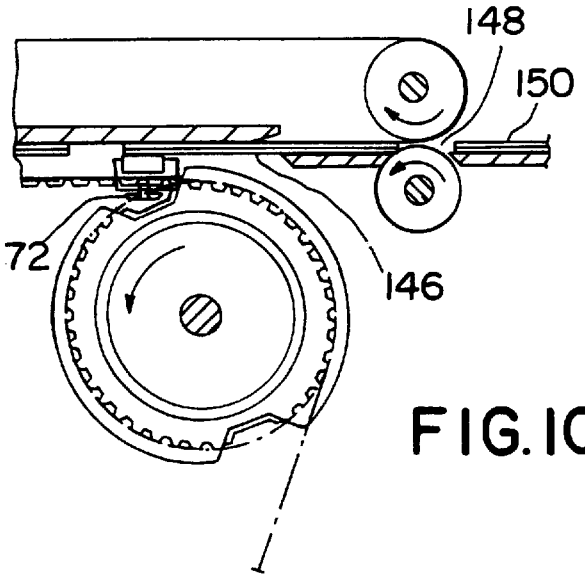

A suitable drive continuously moves the upper run 56 of belt 50 downstream between rollers 52 and 54 at the same speed that the lower run 46 of belt 38 moves downstream from roller 40 to roller 42. The mounting plates 60 extend beyond the edges of clamp belt 50, as indicated in FIG. 3, and are seated in opposed recesses 78 formed in the flanges of rollers 52 and 54 as the clamp arms are moved around the rollers. Positive engagement between the clamp arms and rollers supports the arms as they are brought up and into engagement with the under sides of lead ends of severed bundles to clamp the bundles against lower run 46 of belt 38, as illustrated more clearly in FIGS. 8–10 and described more fully below. The drive for belt 50 rotates roller 52 in the direction of arrow 80.

As the clamp arms 58 are moved downstream from roller 52, the end of the base away from belt 38 is fed into a slot in longitudinal guide bar 82. At the same time the end of the base adjacent hinge 64 is brought into engagement on longitudinal support bar 84. Bars 82 and 84 extend along the length of the upper belt run 56. The bars 82 and 84 support arms 58 to insure bundles are properly clamped against the lower run of belt 38 during movement to the stacking stations 18 and 20. Each plate 72 has a close sliding fit between bars 82 and 84 to prevent longitudinal shifting of the clamp arms. Longitudinal shifting of the clamp elements could shift the plies in the multiply bundles and cause uneven stacks.

As illustrated in FIG. 2, roller 40 is located immediately downstream from the nip between knife roll 24 and anvil roll 28, and is located above driven roller 86. Plate 88 extends from the nip downstream past roller 86 and under the upstream end of run 46.

Stacking stations 18 and 20 are spaced along bundle conveyor 16 under belt 38. Station 20 is located further downstream from rolls 14 than station 18 and includes a slotted stack support plate 90 moveably mounted on a pair of vertical support rods 92 permitting vertical movement of the plate between full lowered and elevated positions indicated in FIG. 3. Plate 90 is raised and lowered by a suitable drive, as will be described below. The upstream and downstream ends of the stacking stations are defined by adjustable upstream vertical guide plate 94 and downstream vertical guide plate 96. Plate 96 is mounted on frame 10 by eccentric vibrators 98 which vibrate or jog plate 96 for even stacking of bundles on the support plate.

Stack shift comb 100 is mounted on a pair of parallel horizontal rods 102 and includes a number of spaced fingers 104 which extend upwardly through slots formed in the stack support plate 90. The comb is moveable along rods 102 and is connected to piston rod 108 of hydraulic cylinder 110 which, in turn, is mounted on frame 12. Cylinder 110 moves the fingers 104 from a retracted position where the fingers are located at the bottoms of the slots in plate 90, as shown in solid line in FIG. 3, to an extended position where the fingers have been moved out of the slots in plate 90 and into slots formed in support plate 112 of takeaway conveyor 22. Ninety degree slotted guide plate 114 extends along the outer side of station 20 between plates 94 and 96 to assist in maintaining the orientation of the bundles during stacking. Plate 114 is slotted to permit movement of the fingers between the extended and retracted positions. Bundle support plate 95 extends upstream from the top of plate 94 under conveyor run 46 and includes a right angle upstream-extending portion of plate 94. The plate 95 supports trailing portions of bundles moved downstream by conveyor 16. The upstream end of plate 94 is located above plate 96 of stacking station 18.

Station 18 is like station 20 and need not be described further. Plate 95 of station 18 extends upstream to roller 52, as illustrated in FIG. 2.

A pair of fixed stop or release fingers 116 associated with station 20 are mounted on a cross bar 118 extending between plates 34 and 36 and extend down from the bar to either side of the support plate 48 and clamp arm clamp members 74. The fingers 116 are located above vibrated end plate 96 at the downstream side of the stacking station.

Figure 6:
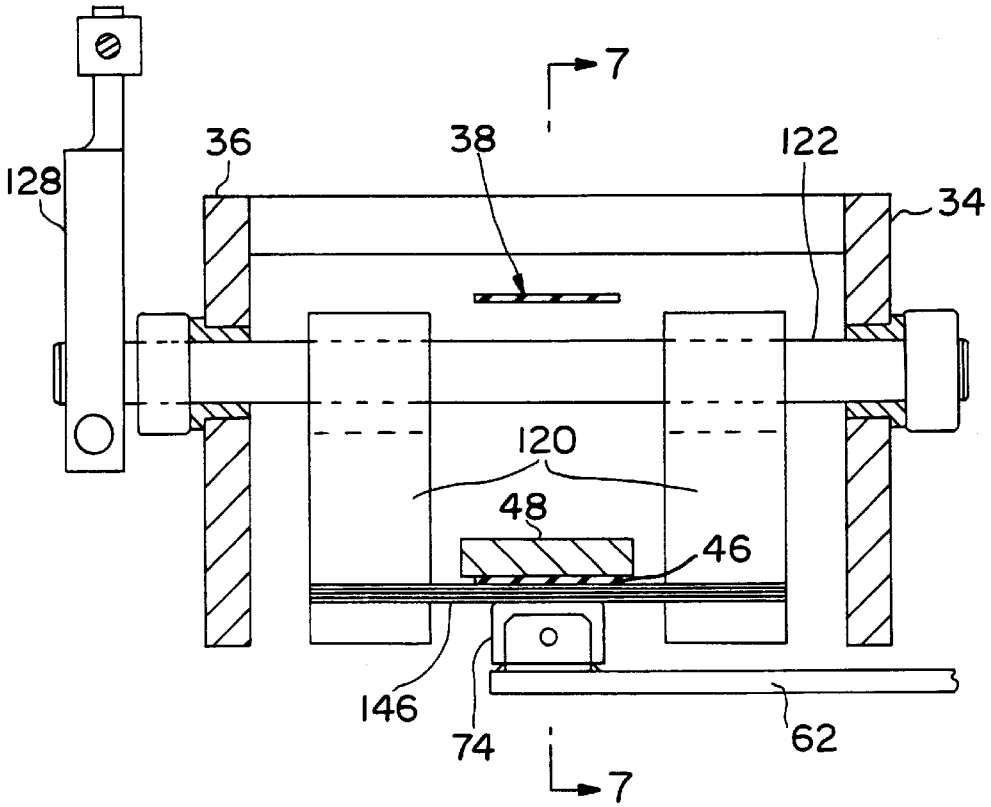
FIG. 6 is a sectional view taken generally along line 6—6 of FIG. 2.

A pair of retractable stop fingers 120 are associated with station 18 are mounted on rotatable shaft 122 journaled in bearings in plates 34 and 36. An air cylinder 124 is mounted on a cross bar 126 extending between plates 34 and 36 and is connected to an end of radial arm 128 on shaft 122. Extension of cylinder 124 positions the stop fingers 120 to either side of the support plate 48, lower conveyor belt run 46 and clamp elements 74, as illustrated in FIG. 6, where the ends of the stop fingers are in the path of downstream movement of the edges of product bundles clamped between elements 74 and lower conveyor run 46. See FIG. 6. Retraction of cylinder 124 rotates and retracts the adjustable stop fingers 120 above the bottom of support plate 48, out of the path of downstream movement of the clamped bundles.

Stack takeaway conveyor 22 includes a pair of spaced apart sprocket gears 130, 132 and a drive chain 134 wound around the gears and having an upper run 136 located a short distance below plate 112. A plurality of spaced pusher fingers 138 are mounted at spaced intervals on chain 134. The fingers 138 on the upper run 136 extend upwardly through slot 140 in the plate and project above the plate to engage product stacks discharged from stacking stations 18 and 20 and onto plate 112 and move the stacks downstream to discharged belts 142 on takeaway conveyor extension 144.

The operation of stacking machine 10 will now be described.

Figure 8:
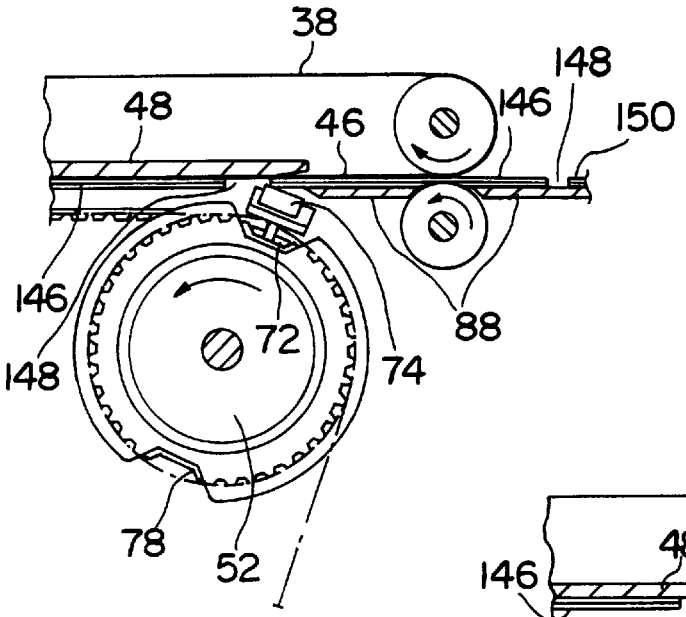
FIGS. 8, 9 and 10 are views illustrating gripping of the lead end of a multiply bundle.

The stacking machine operates continuously to sever successive bundles of folded web material from the lead end of a multiply rope fed in the direction of arrow 32 to cutoff rolls 14. The rope is fed downstream through the cutoff rolls 14 and onto plate 88. The downstream end 150 of the rope is fed between downstream rotating rolls 40 and 86 before the rope is severed to form a bundle. Belt 34 and roll 86 move downstream at a speed faster than the feed speed of the rope and the belt and roll slip on the top and bottom of the lead end of the rope until the bundle is severed, then engage the new bundle and accelerate the bundle away from the nip of cutter rolls 14. The severed bundle is then fed downstream between roll 86 and the conveyor belt 34 wrapped around the roll 44 at a speed greater than the speed at which the rope is fed downstream, creating gap 148 between the end of the rope and the bundle. The downstream fed bundle, confined between the conveyor belt 38, and plate 88 is fed past the end of plate 88 as shown in FIG. 8. At this time a clamp arm 58 on belt 50 is rotated up around roller 52 and is raised up under belt run 46 and into contact with the downstream end of bundle 146 to positively clamp the lead end of the bundle against the downstream conveyor run 46, which, in turn, is supported by plate 48. Clamping occurs while the bundle is held between the belt and roller 86 and while the base of the clamp arm is positively supported in a notch 78 on roller 52 to increase the initial contact pressure between the clamp element 74 and the conveyor belt run 46. Positive clamping ensures that the bundle is held on the belt and moves downstream with the belt. Clamping occurs without longitudinal or lateral relative movement between belt run 46, bundle 146 and the clamp element 74. Gap 148 widens until the next bundle is severed from the rope.

The lead ends of the rope and of bundles cut from the rope are positively held on the conveyor at all times prior to release at a stacking station, to insure proper feeding and to prevent fold back of the edges of the dry webs in the bundle. Rolls 40 and 86 are spaced a distance downstream from the nip of cutoff rolls 14 less the length of the bundle to insure that the bundle is captured prior to severing from the rope. Likewise, the position on conveyor 16 at which the lead end of the bundle is securely clamped against run 46 and plate 48 is located a distance downstream from rolls 40 and 86 less than the length of the bundle 146. The speed of conveyor 16 is greater than the speed at which rope 150 is fed to the cutoff rolls and insures a wide gap 148 between adjacent bundles so that bundles are dropped at stations 18 and 20 free of adjacent upstream bundles.

After the lead end of a bundle has been firmly clamped between a clamp element 74 and the downstream moving run 46 the arm 58 is moved from notch 78 and downstream with run 46 to convey the clamped bundle downstream toward the stacking stations 18 and 20. A continuous stream of severed bundles are each clamped against run 46 and moved toward the stacking stations. Springs 66 hold the clamp elements up against the bundles.

Figure 7:
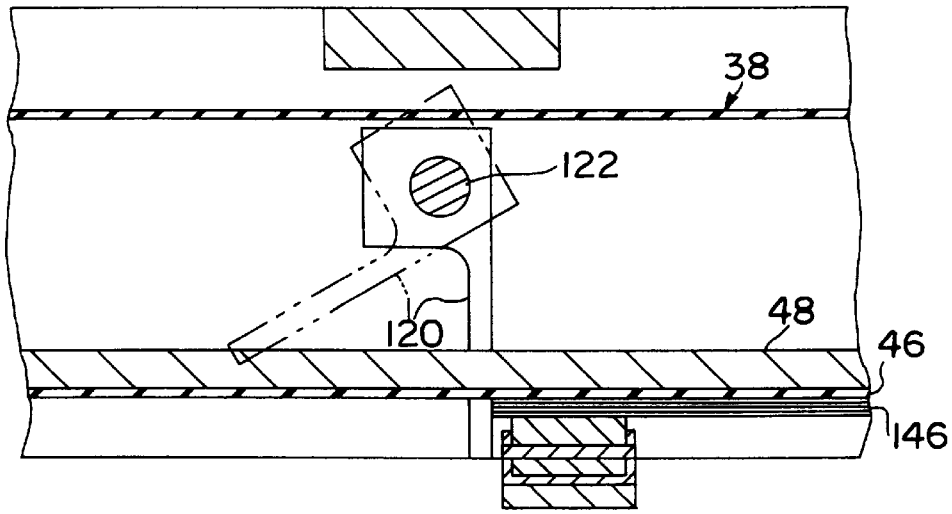
FIG. 7 is a sectional view taken along line 7—7 of FIG. 6.

Clamped bundles 146 are moved downstream along conveyor 16 and are stripped from between the clamp arms and belt 38 at either stacking station 18 and 20, depending upon the position of adjustable stop fingers 120. Stripping of a bundle from between a clamped element 74 and lower conveyor run 46 occurs when the sides of the lead end of the bundle are brought into contact with a pair of stop fingers 116, 120 which are extended into the path of movement of the bundle. See, for instance, FIG. 6. The clamped, moving bundle contacts and is stopped by the fingers. The lower conveyor run 46, and clamp element 74 on the arm 58 continue to move downstream past the stripped bundle. Stop fingers 116 and 120 are located above the downstream end plates 96 of stacking stations 20 and 18, respectively, so that stripped bundles fall down into the stations. When the fingers 120 are in the extended solid line position shown in FIGS. 6 and 7 the bundles are stripped from the arms and conveyor at stacking station 18 and are collected in a stack at station 18. When fingers 120 are retracted as shown in dashed lines in FIG. 7 the bundles are conveyed downstream past station 18 to station 20 and are stripped from the arms and conveyor belt at station 20 by fixed stop FIGS. 116 to be collected into a stack at station 20.

Stacking machine 10 operates continuously feeding bundles 146 alternately to stations 18 and 20 to form bundle stacks 152 at each station and then discharge the stacks from the stations onto the takeaway conveyor 22 for discharge from the machine. During stacking a set number of successive bundles 146 are stripped from between the clamp arms and belt 38 at one of the stacking stations and fall down onto the station stack support plate 90. Before stacking begins, plate 90 is raised to an extended position illustrated in dashed lines in FIG. 3, a short distance below lower belt run 46. The plate is automatically lowered as the stack height grows to maintain a constant drop distance for the bundles to insure uniform stacking. During stacking vibrators 98 are actuated to jog plates 96 and improve the quality of the stacks. The length of bundles 146 is slightly less than the spacing between end plates 94 and 96. Further, the width of the bundles is slightly less than the spacing between fingers 104 of comb 100, when retracted and guide plate 114. The geometries of the two stations 18 and 20 insure that the rectangular bundles fall down from conveyor 16 and are collected in a uniform stack 152 on descending support plate 90.

After the proper number of bundles for making up full stack 152 have been collected at a first station 18, 20 cylinder 124 is actuated to either retract or extend arms 120 so that the bundle conveyor moves successive bundles to the other stacking station where the bundles are stripped from between the clamp arms and belt, fall down on raised plate 90 and form a second stack.

At this time, the support plate at the first stacking station is fully lowered or has previously been lowered to the level of plate 112 of takeaway conveyor 22 as shown in FIG. 3. Cylinder 110 for the station is then retracted to move the shift comb 100 from the extended solid line position to the retracted dashed line position shown in FIG. 3 and shift the completed stack 152 from support plate 90 onto plate 112 between a pair of pusher fingers 138. The drive for takeaway conveyor chain 134 is then actuated to push the completed stack downstream along conveyor 22 and onto the takeaway belts 142 for subsequent operations, which conventionally include packaging of the stack. Cylinder 110 is then extended to retract the comb 100 and the plate drive is actuated to fully raise plate 90 and return the stacking station to position for receiving the first bundle of the next stack to be formed at the station. The drive for takeaway conveyor 22 is deactivated until another stack is placed on plate 112.

Rope 150 may be formed from a number of plies of folded dry web material. These plies do not adhere to each other in the rope. The lead ends of the rope and of the bundles are confined during transfer from the cutting rolls to clamping on conveyor belt 38 in order to prevent displacement or fold back of the leaves or edges of the web material.

Machine 10 operates at a high production rate and is capable of cutting and stacking as many as 480 to 600 eight and one-half inch long bundles per minute to form 16 to 20 full height stacks per minute. The bundles may have as many as six or more plies.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A method of forming a stack of multiply articles from a multiply rope, said method comprising the steps of:

(a) repetitively feeding an end of a multiply rope downstream between a support member and an upstream end of a downwardly facing endless conveyor belt to grip a leading portion of the rope between the support member and the conveyor belt;

(b) cutting each leading portion of the rope from the remainder of the rope at a location upstream of the support member to deliver a succession of multiply articles to the conveyor belt;

(c) conveying each article downstream with the conveyor belt;

(d) clamping a downstream portion of each article up and against the conveyor belt before an upstream portion of the article is released from between the support member and the conveyor belt;

(e) moving the clamped articles downstream with the conveyor belt to a stacking station, and unclamping each clamped article from the conveyor belt at the stacking station; and (f) collecting the unclamped articles at the stacking station to form a stack of multiply articles.

2. The method of claim 1 including the step of:

(g) separating adjacent clamped members along the conveyor belt.

3. The method of claim 1 wherein the holding member comprises a roller extending across the upstream end of the conveyor belt, including the steps of:

(g) driving the roller at a circumferential speed equal to a downstream speed of the conveyor belt; and (h) feeding the end of the multiply rope between the roller and conveyor belt at a downstream speed less than the downstream speed of the conveyor belt.

4. The method of claim 1 wherein the articles are clamped on the conveyor belt by clamp members including the steps of:

(g) positioning an article release member associated with the stacking station in the path of movement of the clamped articles; and (h) moving the clamped articles into contact with the article release member to strip the articles from between the belt and clamp members.

5. A method of forming stacks of segments cut from the lead end of a web, comprising the steps of:

(a) repetitively feeding the end of a web downstream between a holding member and a downstream moving and downwardly facing conveyor to hold an end segment of the web up against the conveyor;

(b) cutting each held end segment of the web from the remainder of the web at a location upstream from the holding member to form a succession of web segments on the conveyor;

(c) moving each web segment downstream on the conveyor;

(d) clamping each web segment up against the conveyor at a location downstream from the holding member before the web segment moves past the holding member;

(e) moving each clamped web segment downstream with the conveyor to a stacking station, and unclamping the web segment from the conveyor at the stacking station; and (f) collecting unclamped web segments in a stack at the stacking station.

6. The method of claim 5 including the step of:

(g) dropping the web segments below the conveyor at the collecting station to form the stack.

7. The method of claim 5 including the step of:

(g) spacing adjacent web segments apart from each other along the conveyor.

8. The method of claim 5 including the step of:

(g) stripping the web segments from between the conveyor and a clamp member at the stacking station.

9. The method of claim 5 wherein the holding member comprises a roller extending across the conveyor, comprising the step of:

(g) rotating the roller downstream at a circumferential speed equal to the downstream speed of the conveyor.

10. The method of claim 5 including the step of:

(g) feeding the end of the web downstream at a speed slower than the downstream speed of the conveyor.

11. A method of forming a stack of elongate articles comprising the steps of:

(a) repetitively feeding elongate articles in a downstream direction to move the articles between first and second holding members;

(b) clamping the leading portion of each article up against the lower surface of a downstream moving conveyor before the trailing portion of each article is released from the holding members and then releasing the trailing portion of each article from between the holding members;

(c) conveying each clamped article downstream along the conveyor to a stacking station and unclamping the article from the conveyor at the stacking station; and (d) stacking the articles at the stacking station.

12. The method of claim 11 including the step of:

(f) performing a cutting operation on the trailing end of each article to sever the article from a web.

13. The method of claim 11 including the steps of:

(g) locating a two-roll cutter upstream of the first and second holding members;

(h) repetitively feeding a leading end of the web through the two-roll cutter to the holding members; and (i) cutting the web with the cutter after the leading end of the web is gripped by the holding members.

14. The method of claim 11 including the step of:

(e) spacing the articles apart from each other along the conveyor.

15. The method of claim 14 including the steps of:

(f) feeding the articles to the holding members at a first speed; and (g) moving the clamped articles downstream along the conveyor at a second speed greater than the first speed.

* * * * *